US009667037B2

(12) United States Patent
Niessner et al.

(10) Patent No.: US 9,667,037 B2
(45) Date of Patent: May 30, 2017

(54) PRECHAMBER SPARK PLUG FOR A GAS-POWERED INTERNAL COMBUSTION ENGINE

(71) Applicant: Federal-Mogul Ignition GmbH, Neuhaus-Schierschnitz (DE)

(72) Inventors: Werner Niessner, Steinheim (DE); Francisco Villaverde, Stuttgart (DE)

(73) Assignee: Federal-Mogul Ignition GmbH, Neuhaus-Schierschnitz (DE)

( * ) Notice: Subject to any disclaimer, the term of this patent is extended or adjusted under 35 U.S.C. 154(b) by 0 days.

(21) Appl. No.: 15/278,577

(22) Filed: Sep. 28, 2016

(65) Prior Publication Data

US 2017/0104316 A1 Apr. 13, 2017

(30) Foreign Application Priority Data

Oct. 7, 2015 (DE) ..... 10 2015 117 113

(51) Int. Cl.
*H01T 13/32* (2006.01)
*H01T 13/54* (2006.01)

(52) U.S. Cl.
CPC ..... *H01T 13/54* (2013.01); *H01T 13/32* (2013.01)

(58) Field of Classification Search
CPC ..... H01T 13/54; H01T 13/32
See application file for complete search history.

(56) References Cited

U.S. PATENT DOCUMENTS 4,360,690 A 11/1982 Fuchs
4,452,189 A 6/1984 Latsch
4,513,708 A 4/1985 Latsch
5,554,908 A 9/1996 Kuhnert
7,849,830 B2 12/2010 Maul
7,922,551 B2 4/2011 Tozzi
8,181,617 B2 5/2012 Kuhnert
8,350,457 B2 1/2013 Thomas
8,536,769 B2 9/2013 Kuhnert
8,584,648 B2 11/2013 Chiera
8,839,762 B1 9/2014 Chiera
(Continued)

FOREIGN PATENT DOCUMENTS

DE 3025218 A1 2/1982
DE 3025896 A1 2/1982
(Continued)

OTHER PUBLICATIONS

German Office Action for Application No. 102015117113.9 Dated Jun. 8, 2016, 8 Pages.

*Primary Examiner* — Joseph L Williams
(74) *Attorney, Agent, or Firm* — Reising Ethington, P.C.

(57) ABSTRACT

A prechamber spark plug for a gas-powered internal combustion engine having: a metallic body, an insulator, a center conductor connected to a center electrode, a ground electrode, and a cap that is attached to a front end of the body and forms a prechamber. The prechamber can be subdivided into a front part and a back part by an imaginary separating plane that is perpendicular to the center conductor at an end face of the center electrode. The front part of the prechamber is located on the front side of the separating plane, and the back part is located inside the body on the back side of the separating plane so that the volume of the back part is larger than the volume of the front part. Apart from its connection to the front part of the prechamber, the back part is closed in a gas-tight manner.

10 Claims, 1 Drawing Sheet

(56) References Cited

U.S. PATENT DOCUMENTS

| | | | |
|---|---|---|---|
| 8,890,396 | B2 | 11/2014 | Ernst |
| 9,172,217 | B2 | 10/2015 | Hampson |
| 2013/0206101 | A1 | 8/2013 | Douglas |
| 2014/0102404 | A1 | 4/2014 | Sotiropoulou |
| 2015/0194793 | A1 | 7/2015 | Yamanaka |

FOREIGN PATENT DOCUMENTS

| | | | |
|---|---|---|---|
| DE | 3230793 | A1 | 2/1984 |
| DE | 102005017186 | A1 | 10/2006 |
| DE | 102010004851 | | 6/2011 |
| DE | 102014004943 | A1 | 2/2015 |
| EP | 1701419 | A1 | 9/2006 |
| EP | 2525452 | | 11/2012 |
| GB | 526218 | A | 9/1940 |
| WO | WO2004107518 | A1 | 12/2004 |

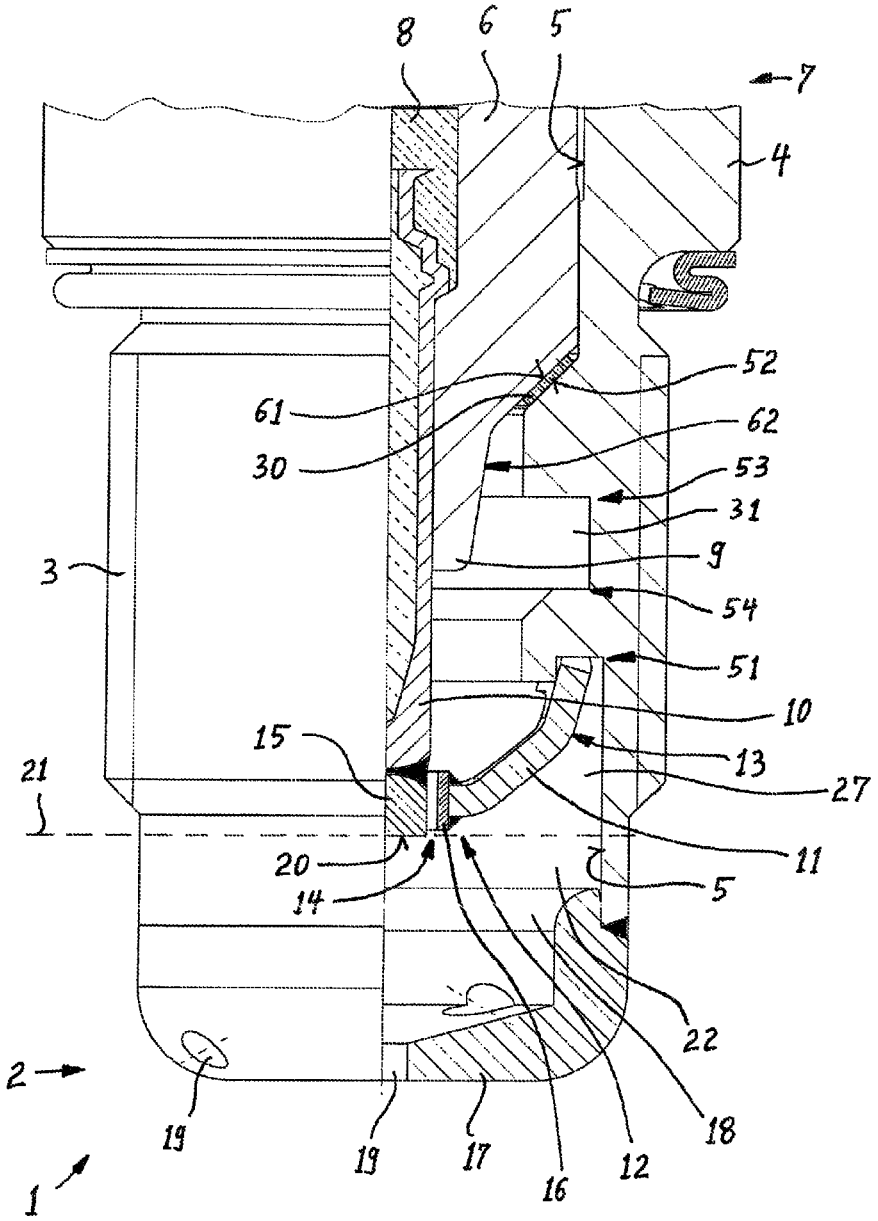
8
6
5
7
4
52
61
62
30
53
31
9
3
54
51
10
15
13
21
27
11
20
5
14
22
2
18
19
19
17
16
12
1

PRECHAMBER SPARK PLUG FOR A GAS-POWERED INTERNAL COMBUSTION ENGINE

This application claims the benefit of German Application No. 10 2015 117 113.9, filed on Oct. 7, 2015 the contents of which are hereby incorporated by reference in their entirety.

FIELD

The invention generally relates to a prechamber spark plug for a gas-powered internal combustion engine.

BACKGROUND

A prechamber spark plug is disclosed in DE 10 2010 004 851 A1. In this spark plug, the center electrode and the ground electrode do not project directly into the combustion chamber of the internal combustion engine, but instead into a prechamber that is formed at the front end of the spark plug and communicates with the combustion chamber of the internal combustion engine through one or more openings. As a result of the openings in the prechamber, an exchange of gas is possible between the prechamber and the combustion chamber. Spark plugs of this type are known as prechamber spark plugs, and are used for the ignition of lean combustion gas/air mixtures in stationary, gas-powered internal combustion engines. A fuel/air mixture is referred to as lean when the ratio, lambda, of the quantity of air actually present in the combustion chamber to the quantity of air stoichiometrically required for complete combustion of the combustion gas is greater than 1, where lambda values of 1.6 to 2.0 are desired. In the compression stroke of the internal combustion engine, an ignitable mixture is introduced into the prechamber through the openings of the prechamber. In terms of its function, the prechamber is a precombustion chamber. The ignitable combustion gas/air mixture flowing into the prechamber is first ignited in the prechamber by means of an ignition spark produced between the center electrode and the ground electrode of the spark plug. The flame produced in the prechamber is ejected from the prechamber through the openings therein as a result of the pressure of the combustion arising in the prechamber, and ignites the lean combustion gas/air mixture present outside the precombustion chamber in the combustion chamber of the internal combustion engine.

SUMMARY

An object of the present design is to create an improved prechamber spark plug of the initially mentioned type with which ignition of the combustion gas/air mixture can be improved.

This object may be attained by a prechamber spark plug with the features specified in claim 1. Advantageous further developments of the invention are the subject matter of the dependent claims.

The prechamber spark plug has a metallic body with a passage and with an external thread, located at its front end, for screwing into the internal combustion engine. Mounted in the passage of the body is an insulator that projects out of the body at the back end facing away from the front end. The insulator surrounds a center conductor that passes through the insulator and that is connected in an electrically conductive manner to a center electrode projecting out of the front end of the insulator. The center electrode forms a spark air gap together with a ground electrode, which is connected in an electrically conductive manner to the body. The center electrode and/or the ground electrode can be equipped, at the surface that borders the spark air gap, with a precious metal reinforcement. Attached to the front end of the body is a cap that shields the center electrode and the ground electrode from a combustion chamber of the internal combustion engine after the prechamber spark plug is installed in the internal combustion engine, and that, together with the body, forms a prechamber in which the center electrode and the ground electrode are located. The cap has at least one opening that permits gas exchange between the prechamber and the space outside of the prechamber, namely the combustion chamber of the internal combustion engine. The prechamber can be subdivided into a front part and a back part by an imaginary separating plane. The separating plane is perpendicular to the center conductor and is placed at the end face of the center electrode that projects from the insulator. The front part of the prechamber is located on the side of the separating plane facing the front end of the spark plug, and the back part of the prechamber is located on the side of the separating plane facing the back end of the spark plug. The back part of the prechamber is arranged inside the spark plug, in particular inside the body.

Since the separating plane only notionally divides the prechamber into two parts, these parts communicate with one another at the separating plane. Apart from this connection of the back part of the prechamber to the front part of the prechamber at the separating plane, the back part of the prechamber is closed in a gas-tight manner. "Gas-tight" means that no gases can escape from the back part of the prechamber—apart from the gas exchange with the front part of the prechamber taking place at the separating plane—during operation. The volume of the back part of the prechamber is larger than the volume of the front part of the prechamber. The volume of the back part of the prechamber can be greater than the volume of the front part of the prechamber by a factor of 1.1 to 2.0, in particular by a factor of 1.2 to 1.7.

The present design may have advantages listed in the following paragraphs:

The ignition can be improved by the size ratios with both a small and a large total volume of the prechamber. The size of the total volume of the prechamber can be varied in additional ranges in this way in order to optimally adapt the prechamber spark plug to the internal combustion engine and its operating conditions. In this context, the essential advantage of spark plugs of the generic type that have a ground electrode connected to the body and matched to the center electrode is preserved, specifically in that the ignition takes place substantially in the center of the prechamber and the flame front can propagate within the prechamber essentially unhindered in all directions.

The prechamber is located entirely within the spark plug, so a prechamber spark plug with a suitably designed prechamber can be screwed in depending on the type and operating conditions of the internal combustion engine. In this way, it is possible to achieve ignition of the combustion gas/air mixture that is optimized for the application case in question of the internal combustion engine.

The inflow and filling of the prechamber with fresh combustion gas/air mixture is improved.

Created behind the imaginary separating plane, which is to say essentially also behind the spark air gap, is an additional, enlarged space into which residual gases from the preceding operating cycle of the internal combustion engine can be displaced during a compression stroke. As a result of this enlarged storage area for residual gases, virtually undiluted fresh combustion gas/air mixture is present at the spark gap between the center electrode and ground electrode so that ignition of the combustion gas/air mixture by the ignition spark is improved, in particular when the back part and the front part of the prechamber have the size ratios disclosed herein.

The prechamber spark plug is simple to manufacture.

Each of GB 526,218 A, DE 3,025 896 A1, and DE 10 2005 017 186 A1 discloses a non-generic prechamber spark plug with no ground electrode. The spark gap is formed directly between a center electrode and an inner wall of the prechamber. Ignition thus takes place in the edge region of the prechamber, and its wall impedes the uniform propagation of the flame front. Moreover, in each of these spark plugs that are of a different class, the back part of the prechamber is not closed in a gas-tight manner. In the spark plug disclosed in GB 526,218 A, a passage leads from the back part of the prechamber through a valve to the outside. During the intake stroke, fresh air is drawn through the passage into the prechamber, which is intended to flush residual gases from the prechamber. DE 3,025,896 A1 discloses an annular space in a combustion chamber wall into which the spark plug is screwed, this space surrounding the body and communicating with the prechamber through radial through-holes. In the prechamber spark plug disclosed in DE 10 2005 017 186 A1, residual gases are removed to an annular temporary holding chamber outside of the spark plug or are guided through conduits to the intake manifold of the internal combustion engine. Additionally disclosed in DE 10 2005 017 186 A1 is a non-generic prechamber spark plug in which a small quantity of additional fuel is brought in a valve-controlled manner into the prechamber through radial openings located in the body in the region of its external thread.

According to another embodiment, an annular seat for the insulator is arranged in the passage of the body, where the passage becomes narrow—when viewed in the direction from the back end to the front end of the spark plug. The insulator can have an annular bearing surface, in particular shoulder, with which it is supported in the axial direction on the annular seat of the body. The annular seat of the body and the annular bearing surface of the insulator are matched to one another in such a manner that they fit against one another in a gas-tight manner, wherein the gas tightness can be ensured, in particular, by a seal located between them so that no gases from the back part of the prechamber can enter the back part of the passage. The passage can widen in at least one point in the back part of the prechamber—when viewed in the direction from the back end to the front end—in particular at a point between the annular seat for the insulator and the separating plane. The widening can be stepped, in particular. The widening can also contain a conical section and/or a section with a rounded radius.

The ground electrode can, in particular, be located completely in the back part of the prechamber. The ground electrode can be attached to the body at an attachment point located within the passage. In particular, the attachment point can be located in the back part of the prechamber. The passage can widen—when viewed in the direction from the back to the front—at the attachment point of the ground electrode and/or at a point located between the attachment point and the annular seat for the insulator, in particular can widen in a stepped manner. The ground electrode can, in particular, contain an annular section that can annularly surround the center electrode. The surface of the ground electrode surrounding the center electrode can be equipped with or tipped with an annular precious metal reinforcement. The ground electrode can have at least one arm section that extends from the section annularly surrounding the center electrode to the attachment point on the body.

In another embodiment, the passage can narrow—when viewed in the direction from the back to the front—at a point that is located between the annular seat for the insulator and the attachment point of the ground electrode. This narrowing can be stepped, in particular. As a result of this narrowing in combination with an above-mentioned widening of the passage, it is possible to create, in the back part of the prechamber, an enlarged annular space that surrounds a section of the insulator and/or a section of the center electrode projecting out of the insulator. As a result of this enlarged annular space, the size ratios of the front and back parts of the prechamber can be achieved in an especially simple manner. The front part of the prechamber can contain multiple cylindrical, in particular circular cylindrical, sections. The back part of the prechamber can contain multiple annular, in particular ring-shaped, sections. In this context, all sections of the prechamber can be arranged to be coaxial to the center conductor. Such a symmetrical design of the prechamber fosters good ignition.

DRAWINGS

Preferred exemplary embodiments will hereinafter be described in conjunction with the appended drawings, wherein like designations denote like elements, and wherein:

FIG. 1 a prechamber spark plug, of which only a region at its front end is shown partially in longitudinal section.

DESCRIPTION

Shown in FIG. 1 is a prechamber spark plug 1 in the region of its front end 2, on which is located an external thread 3 for screwing into an internal combustion engine that is not shown. The external thread 3 is located on a metallic body 4. The body 4 has a passage 5 in which an insulator 6 is attached in a manner that is known per se. At the back end 7 facing away from the front end 2, the insulator 6 projects out of the body 4 in a manner that is not shown. The insulator 6 surrounds a center conductor 8 that passes through the insulator 6 and that is connected in an electrically conductive manner to a center electrode 10 projecting out of the front end 9 of the insulator 6. The prechamber spark plug 1 contains a ground electrode 11 that is attached to the body 4 at an attachment point 51. When viewed from the back end 7 to the front end 2, the passage 5 widens in a stepped manner at the attachment point 51. The ground electrode 11 has an annular section 12 that surrounds the center electrode 10. The ground electrode 11 additionally has multiple arm sections 13 by means of which the center electrode 11 is attached to the body 4 and of which one can be seen in FIG. 1. Provided between the center electrode 10 and the annular section 12 of the ground electrode 11 is an annular spark gap 14 that constitutes a spark air gap. At its front end, the center electrode 10 is tipped with a precious metal 15 or with a precious metal alloy. The annular section 12 of the ground electrode 11 is tipped annularly on its inner side facing the center electrode 10 with a precious metal 16 or with a precious metal alloy. The surfaces of the center electrode 10 and ground electrode 11 facing one another and composed of the precious metal 15, 16 or precious metal alloy are coaxially arranged lateral surfaces of circular cylinders.

Attached to the front end 2 of the body 4 is a cap 17 that, together with the body 4, forms a prechamber 18 in which the center electrode 10 and the ground electrode 11 are located. The cap 17 has multiple through holes 19 that permit gas exchange between the prechamber 18 and the combustion chamber of the internal combustion engine that is not shown.

An imaginary separating plane can be placed at the front end face 20 of the center electrode 10; this imaginary plane is perpendicular to the center conductor 8 and is indicated by the dashed line 21 in FIG. 1. The prechamber 18 is subdivided into a front part 22 and a back part 27 by the separating plane 21. The front part 22 is located on the side of the separating plane 21 facing the front end 2 of the prechamber spark plug 1, and the back part 27 of the prechamber 18 is located on the side of the separating plane 21 facing the back end 7 of the prechamber spark plug 1. The back part 27 is located entirely within the prechamber spark plug 1. The ground electrode 11 and its attachment point 51 are located entirely within the back part 27. The front part 22 and the back part 27 communicate with one another at the separating plane 21 so that gas exchange between the front part 22 and the back part 27 can take place across the separating plane 21. Apart from this connection to the front part 22, the back part 27 is closed in a gas-tight manner. The front part 22 communicates with the space outside of the prechamber 18 through the openings 19. The volume of the back part 27 is larger than the volume of the front part 22 in order to achieve better ignition of the combustion gas/air mixture in the prechamber 18.

Arranged in the passage 5 is an annular seat 52 for the insulator 6, where the passage 5 narrows conically in the direction from the back end 7 to the front end 2. The insulator 6 has a bearing surface 61 that is matched to the seat 52 and is likewise annular and conical. A seal 30 is arranged between the seat 52 and the bearing surface 61 in order to seal the back part 27 of the prechamber 18. The insulator 6 is supported by its bearing surface 61 on the seat 52 in the axial direction. Arranged between the seat 52 and the separating plane 21, in addition to the point 51, is another point 53 at which the passage 5 widens—in the direction from the back end 7 to the front end 2—in a stepped manner. Located between the widening 53 and the attachment point 51 is a point 54, where the passage 5 narrows in a stepped manner. Formed between the widening 53 and the narrowing 54 is an enlarged annular space 31 that increases the volume of the back part 27 of the prechamber 18 in a manner that improves ignition of the combustion gas/air mixture.

The bearing surface 61 of the insulator 6 is designed as an annular shoulder. The insulator 6 continues further past the shoulder 61 with a conically tapering "insulator nose" 62 all the way to its front end 9. The annular space 31 also surrounds the front end 9 of the insulator 6 in addition to the center electrode 10.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

LIST OF REFERENCE NUMERALS

1 prechamber spark plug
2 front end
3 external thread
4 body
5 passage
6 insulator
7 back end
8 center conductor
9 front end of the insulator
10 center electrode
11 ground electrode
12 annular section
13 arm section
14 spark gap
15 precious metal
16 precious metal
17 cap
18 prechamber
19 through hole
20 end face
21 separating plane
22 front part
27 back part
30 seal
31 annular space
51 attachment point
52 seat
53 widening
54 narrowing
61 bearing surface
62 insulator nose

The invention claimed is:

1. A prechamber spark plug for a gas-powered internal combustion engine, comprising:

a metallic body with a passage and an external thread located at a front end for screwing into the internal combustion engine;

an insulator mounted in the passage of the body that projects out of the body at a back end facing away from the front end;

a center conductor surrounded by the insulator that passes through the insulator and is connected in an electrically conductive manner to a center electrode projecting out of the front end of the insulator;

a spark air gap formed between the center electrode and a ground electrode, which is connected in an electrically conductive manner to the body;

a cap attached to the front end of the body that shields the center electrode and the ground electrode from a combustion chamber of the internal combustion engine after the prechamber spark plug is installed in the internal combustion engine, and that, together with the body, forms a prechamber in which the center electrode and the ground electrode are located;

the cap has at least one opening that permits gas exchange between the prechamber and the space outside of the prechamber;

the prechamber can be subdivided into a front part and a back part by an imaginary separating plane that is perpendicular to the center conductor at an end face of the center electrode that projects out of the insulator;

the front part of the prechamber is located on a side of the separating plane facing the front end of the prechamber spark plug;

the back part of the prechamber is located on a side of the separating plane facing the back end of the prechamber spark plug, is arranged inside the prechamber spark plug, and apart from its connection to the front part of the prechamber at the separating plane is closed in a gas-tight manner;

wherein a volume of the back part of the prechamber is larger than a volume of the front part of the prechamber.

2. The prechamber spark plug according to claim 1, wherein the volume of the back part of the prechamber is greater than the volume of the front part of the prechamber by a factor of between 1.1 to 2.0.

3. The prechamber spark plug according to claim 1, wherein the ground electrode is located completely in the back part of the prechamber.

4. The prechamber spark plug according to claim 1, wherein the ground electrode annularly surrounds the center electrode.

5. The prechamber spark plug according to claim 1, wherein an annular seat for the insulator is arranged in the passage of the body where the passage becomes narrow when viewed in the direction from the back end to the front end, and wherein the insulator has an annular bearing surface with which it is supported in the axial direction on the annular seat.

6. The prechamber spark plug according to claim 5, wherein the passage between the annular seat and the separating plane widens when viewed in the direction from the back end to the front end, in at least one point.

7. The prechamber spark plug according to claim 1, wherein the ground electrode is attached to the body at an attachment point located within the passage.

8. The prechamber spark plug according to claim 7, wherein the attachment point is located in the back part of the prechamber.

9. The prechamber spark plug according to claim 6, wherein the passage widens when viewed in the direction from the back end to the front end at the attachment point and/or at a point located between the annular seat and the attachment point.

10. The prechamber spark plug according to claim 9, wherein the passage narrows when viewed in the direction from the back end to the front end at a point that is located between the annular seat for the insulator and the attachment point of the ground electrode.

* * * * *